United States Patent [19]

Kinney

[11] 4,084,488

[45] Apr. 18, 1978

[54] METHOD AND APPARATUS FOR FORMING PLEATED CLOSURE CONSTRUCTION

[75] Inventor: Alfred W. Kinney, Kansas City, Mo.

[73] Assignee: Phillips Petroleum Company, Bartlesville, Okla.

[21] Appl. No.: 630,577

[22] Filed: Nov. 10, 1975

[51] Int. Cl.[2] ..... B31F 1/00

[52] U.S. Cl. ..... 93/36 B; 93/1 D; 93/60

[58] Field of Search ..... 93/1.3, 60, 36 B, 1 D; 113/1 F, 121 R, 121 A, 121 C

[56] References Cited

U.S. PATENT DOCUMENTS

| | | | |
|---|---|---|---|
| 783,889 | 2/1905 | Perkins et al. | 93/60 |
| 2,180,243 | 11/1939 | Kniesche | 93/48 |
| 2,411,082 | 11/1946 | Conti | 93/60 |
| 2,699,274 | 1/1955 | De Villers | 223/7 |
| 2,832,522 | 4/1958 | Schlanger | 93/60 X |
| 3,054,144 | 9/1962 | Goodwin et al. | 93/1.3 X |
| 3,344,580 | 10/1967 | Griner | 93/60 UX |
| 3,408,902 | 11/1968 | DeVoe | 93/60 UX |
| 3,550,421 | 12/1970 | Stakel | 93/60 X |

*Primary Examiner*—James F. Coan

[57] ABSTRACT

A closure member constructed from a single flat blank and having an annular flange extending from a flat central portion, the outer surface of the annular flange being substantially continuous, is provided by forming a plurality of pleats running generally perpendicular to the perimeter of the flange andprojecting toward the inside of the annular flange.

25 Claims, 14 Drawing Figures

METHOD AND APPARATUS FOR FORMING PLEATED CLOSURE CONSTRUCTION

This invention relates to the construction of a closure member. In another aspect the invention relates to the construction of a closure member having an improved capability for mating with a sidewall member to produce a container of improved integrity. In yet another aspect the invention relates to an apparatus and method for producing a closure member having pleats at preselected locations on an annular flange thereof and to a closure member so constructed. In still another aspect the invention relates to an apparatus and method for producing a closure member in which the excess material present in a flange of the closure member is pleated in an orderly manner to result in a minimum of disturbance to the mating surface of the flange, and to a closure member so produced.

Closures for various containers, particularly paperboard or plastic coated paperboard closures, are commonly formed with draw punches and dies wherein both the surface of the punch and the surface of the die are smooth. When a closure member having an annular flange extending from a generally planar central surface is constructed from a flat blank using this type of apparatus, the excess material present in the flange, as a result of the excess of original blank area in that portion of the blank from which the flange is formed over the required area of the finished flange, causes pleats of random form and size to appear around the periphery of the drawn flange or skirt of the finished closure. The random pleats are lumpy and present problems when trying to provide a leakproof seal between the closure and a sidewall of a container designed to contain a liquid material, a substance composed of solids and liquids, or a container for dry material which is subject to deterioration by container leakage.

Present methods of making containers leakproof employ the use of extreme pressure applied to a folded-over portion of the combined container wall and closure skirt, such pressure ordinarily being applied with a suitable tool to the inside of an annular flange at the end of a container while the exterior of the container is confined by a retaining ring to maintain the size of the outside of the container and to provide a surface upon which pressure can be exerted. Such a method attempts to flatten the pleats, puckers, or other irregularities which would otherwise prevent an effective seal between the closure skirt and the container sidewall. Even applying such extreme pressures is not entirely effective to prevent leaks in container bottoms, however, and further leakproofing such as coating the annular juncture between the bottom and sidewall of the container by spraying or other suitable treatment of the container interior after the container has been formed, or by caulking the exterior of the bottom of the container, have been necessary to lower the percentage of leaky containers produced to an acceptable level.

Accordingly, an object of the invention is to provide construction of a closure member. Another object is to provide construction of a closure member having an improved capability for mating with a sidewall member to produce a container of improved integrity. Yet another object is to provide an apparatus and method for producing a closure member having pleats at preselected locations on an annular flange thereof and a closure member so constructed. Still another object is to provide an apparatus and method for producing a closure member in which the excess material present in a flange of the closure member is pleated in an orderly manner to result in a minimum of disturbance to the mating surface of the flange, and to provide a closure member so produced.

In accordance with the invention, a container closure is formed using an annular die having a substantially smooth inner surface and a draw punch or plunger means having an annular external surface sized to cooperate with the inner surface of the die ring, the external surface of the plunger having a plurality of grooves formed on the surface thereof with each groove having a central axis which is substantially coplanar with the central axis of the annular external surface of the plunger means. Using this or other suitable apparatus, a peripheral portion of a closure blank is forced to form an annular flange or skirt extending from a planar central portion of the blank with the outer surface of the flange being maintained in a desired shape or size having desired surface characteristics while inwardly protruding pleats extending generally perpendicular to the perimeter of the flange are shaped at preselected locations along the inside of the annular flange. The resulting closure has a flat discoidal central surface and an annular flange depending from the perimeter of the central surface, the flange having a plurality of uniformly spaced pleats protruding inwardly from the inside surface thereof and extending generally perpendicular to the perimeter of the flange. The outside surface of the closure flange will therefore present a substantially smooth and continuous surface which is uninterrupted by bulges, puckers, or lumps of material so that the closure can be mated substantially continuously along its surface to another surface such as a sidewall of a container.

The invention eliminates the uneven pleats and puckers by providing a controlled space for the excess material and by forming the excess material into a preselected series of relatively closed pleats without puckers or other irregularities. In this way a uniform surface is provided for sealing to the sidewall of a container. The minute hairlines that are present on the outside of the closure skirt coinciding with the location of a pleat on the inside of the skirt will ordinarily be the only irregularities in the otherwise smooth exterior skirt surface when a smooth draw die is used in the formation of the closure member. These small lines will ordinarily become filled with the softened polymer or composition coating on the container sidewall or on the closure when the sidewall is tightly wrapped around the closure member in the container making process. When the container wall and closure member are uncoated and an adhesive is used, the adhesive will likewise fill such hairlines. Use of the invention can eliminate the necessarily expensive extra procedure of coating the bottom of the inside of the container after the container has been formed. In addition, the pressure applied to the rim of the container formed by the folded sidewall and closure member can be reduced to a minimal amount or, depending upon the severity of the use to which the container is to be put, the need for such a crimping or expanding step can be eliminated.

Additional objects and advantages of the invention will be apparent from the description of the invention and the appended claims thereto as well as from the drawing in which:

Figure 1:
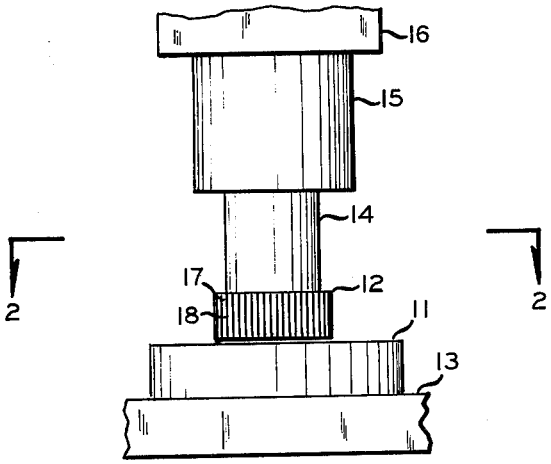
FIG. 1 is an elevation view of the apparatus of the invention.

Referring now to FIG. 1 there is illustrated a die ring means 11 having a passageway therethrough for receiving a draw punch or plunger means 12. The die ring 11 is suitably attached to a rigid member 13 for support. The plunger means 12 is affixed to a shaft 14, the shaft 14 being operably associated with a source of suitable reciprocating motion such as an actuating cylinder 15. The actuating cylinder 15 can be any suitable hydraulic, pneumatic, electrical, or other means for projecting the plunger means 12 into and through the die ring means 11 with the requisite amount of force to form a closure member in accordance with the invention and for withdrawing the plunger means 12 to the position illustrated. The actuating means 15 is in turn mounted upon a rigid member 16. The rigid members 13 and 16 can be a part of any suitable mounting device or system which is capable of maintaining the plunger means 12 and die ring means 11 in the desired juxtaposition and maintaining desired tolerances throughout the closure forming operation. The plunger means 12 has an annulare outer surface 17 upon which are located a plurality of elongated grooves 18 extending along the outer surface 17 with the central axis of each groove 18 being generally coplanar with the central axis of the annular surface 17 of the plunger means 12.

Figure 2:
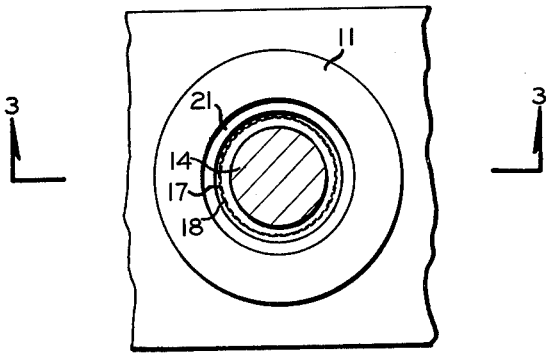
FIG. 2 is a cross sectional plan view of the apparatus viewed along the plane indicated by 2—2 of FIG. 1.

FIG. 2 is a cross sectional view of the apparatus of FIG. 1 showing a cross section of the shaft 14 and illustrating a plan view of the plunger means 12 and die ring 11. A recessed annular surface 21 of the die ring 11 is sized to accept a blank from which a closure member is to be formed and to retain the blank in the proper position prior to the forming operation. As can be seen from the illustration of FIG. 2, a preselected clearance or spacing exists between the inside annular surface of the die ring 11 and the outside annular surface of the plunger 12. The size of this clearance or spacing is determined by the thickness of the blank from which a closure member is to be constructed, by the degree of compression desired to be exerted on various portions of the blank during construction of the closure member, and by other similar factors. From this view it is also clear that the grooves 18 in the surface 17 of the plunger 12 will provide a space into which controlled deformation of the blank material can occur when compression is exerted by coaction of the plunger 12 with the die ring 11.

Figure 3:
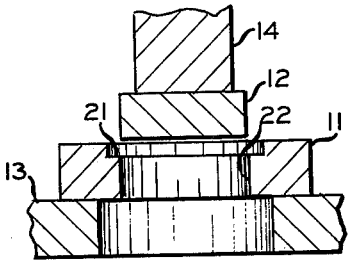
FIG. 3 is a partial elevational cross section of the apparatus viewed along the plane 3—3 of FIG. 2.

FIG. 3 is a partial cross sectional elevation view of the apparatus of FIG. 1 viewed along a plane indicated by 3—3 of FIG. 2. The annular inner surface 22 of the die ring 11 is of substantially the same shape and diameter and has the same surface characteristics as the surface to which the closure member formed therein will be mated. In the majority of packaging applications the inner surface 22 of the die ring 11 will be a smooth cylindrical surface of the same dimension as the surface to which the closure will be mated. The support means 13 upon which the die ring 11 is mounted will have a suitable passageway or opening therethrough to accommodate withdrawal of the formed closure after the blank has been forced through the die ring 11 by the plunger 12.

Figure 4:
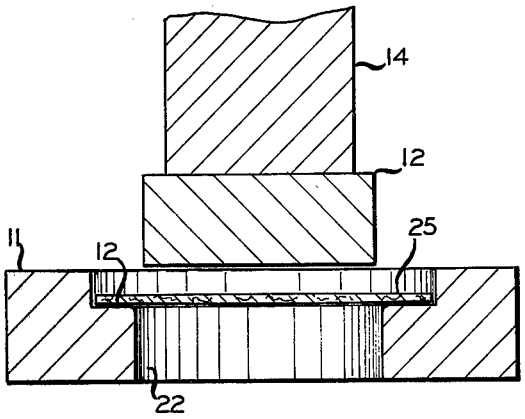
FIG. 4 is a cross sectional view similar to that of FIG. 3 showing a closure blank in position prior to formation of a closure.
Figure 5:
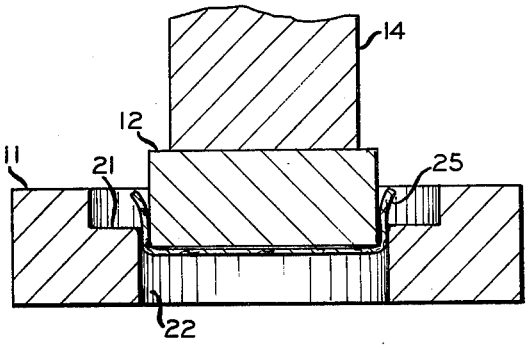
FIG. 5 is a cross sectional view along the same plane as the view of FIG. 4 and illustrates the apparatus of the invention during the formation of a closure.
Figure 6:
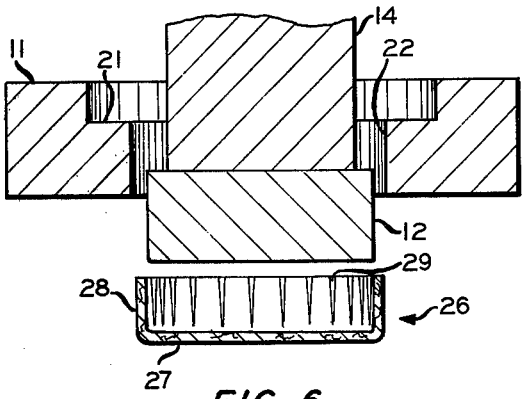
FIG. 6 is a cross sectional view along the same plane as the views of FIGS. 4 and 5 and illustrate the position of the apparatus at the completion of closure formation.

FIGS. 4, 5 and 6 sequentially illustrate the formation of a closure member 26 from a suitable paperboard or coated paperboard blank 25 in accordance with the invention. The blank 25 can be characterized as a discoidal blank having a diameter *d*, circumference *c*, and thickness *t* with the inside diameter D of the inside annular surface of die ring 11 being smaller than the diameter *d* of the blank 25. In FIG. 4 the blank 25 is supported by the recessed surface 21 of the die ring 11 in preparation for passage of the plunger means 12 through the central opening in the die ring 11. In FIG. 5 the plunger 12 has begun penetration into the opening of the die ring 11 forcing a peripheral portion of the blank 25 to begin formation of an annular flange from a peripheral portion of the blank 25. To facilitate formation of a closure without tearing or damaging the blank 25, the edge of the opening of the die ring 11 is preferably suitably rounded. In FIG. 6 the plunger has been extended through the central opening of the die ring 11 with the outer surface of the plunger 12 and the inner surface 22 of the die ring 11 cooperating to produce a closure member 26 having a flat central surface 27 and an annular flange or skirt 28 extending from the central surface 27. The outer surface of the annular flange 28 will be of the size and shape dictated by the annular surface 22, a smooth surface for the illustrated embodiment, and will have on its inner surface a plurality of pleats 29 formed by the expansion of blank material into the groove 18 of the plunger 12 during the closure forming process. In a preferred embodiment the perimeter of plunger 12 measured at a distance $(d-D)/2$ from the leading edge thereof is approximately equal to the circumference c of the blank 25.

Figure 7:
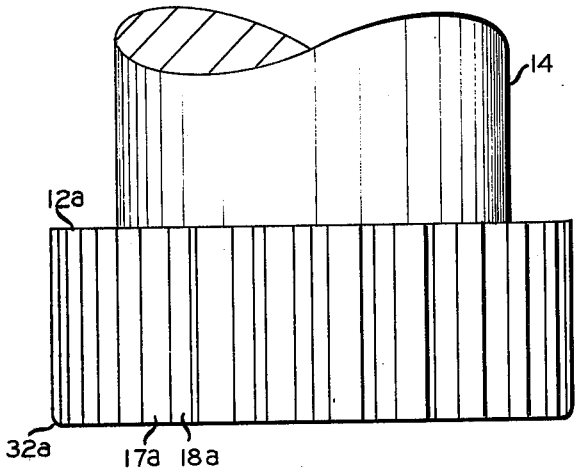
FIG. 7 is an elevational view of a first preferred plunger means of the invention.
Figure 8:
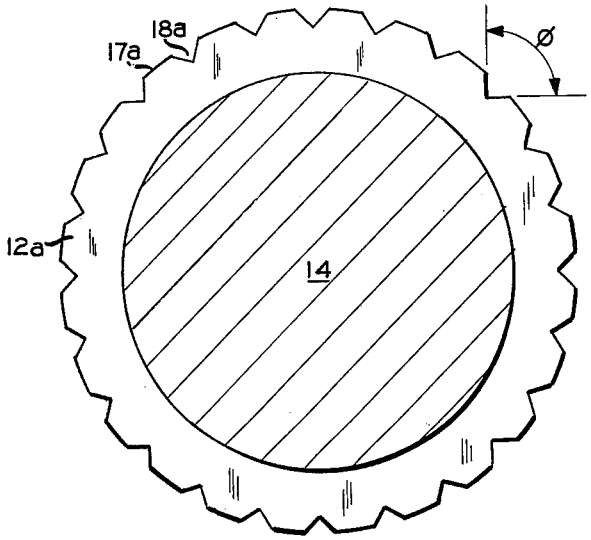
FIG. 8 is a plan view of the plunger means of FIG. 7.

A first preferred embodiment of a plunger means 12 constructed in accordance with the invention is illustrated by FIGS. 7 and 8. The first preferred plunger means **12*a* has a generally cylindrical annular outer surface 17*a* with a plurality of V-shaped grooves 18*a* formed therein. The depth of each groove 18*a* is substantially uniform over its entire length. Each groove 18*a* is substantially straight with its central axis being coplanar with the central axis of the cylindrical surface 17*a*. The leading edge 32*a* of the plunger 12*a*, the edge which first contacts the closure blank and first proceeds into the central opening of the ring die 11, is preferably rounded in order to encourage folding of the blank at a desired radius of curvature and to prevent cutting of the blank by the plunger means 12***a*. While the number of grooves 18*a* in the surface 17*a* of the plunger means 12*a* can vary, the ratio of remaining surface area 17*a* must be sufficient to provide the desired coaction with the ring die 11 to produce a closure member having substantially the same outside shape and dimension as the inside surface 22 of the ring die 11. The depth of each groove 18*a* is preferably less than about 1.3 times the thickness, *t*, of the closure blank with which it is to be used. For smaller pleats, a greater number of grooves each having a depth less than about *t* can be used. The grooves 18*a* of FIGS. 7 and 8 and 18*b* of FIGS. 9 and 10 have been exaggerated in size in order to more clearly show their construction. The depth of the grooves 18*a* along with the diameter of the surface 17*a* compared to the diameter of the surface 22 of the die ring 11 will determine the degree of compression which is exerted on the blank material during the formation of a closure means. The angle $\phi$ formed by the walls of each groove, as well as the degree of rounding of the intersection of the groove walls with the surface 17*a* or with each other, can be selected to yield the best results with the particular material from which the closure blank is to be constructed. For paperboard and coated paperboard blanks, an angle of approximately 90° in combination with little or no rounding of the intersections of the groove walls with the surface 17*a* or with each other is particularly preferred since the 90° angle provides for optimum expansion space into the groove while permitting pressure against the adjacent inner wall 22 of the die ring 11 to be maintained and also provides sharp corners which will crease the blank material and thereby encourage the closure which is formed to return to its desired configuration easily, even though it may be deformed through handling or internal pressures prior to its incorporation into a container.

The preferred plunger embodiment illustrated by FIGS. 7 and 8 provides for maximum compression of the annular flange of the closure means formed therewith at the perimeter of the annular flange 28 opposite its attachment to the central portion 27 of the closure means 26. During formation of a closure means utilizing the plunger 12*a* of FIGS. 7 and 8, there will initially be little or no displacement of material into the grooves 18*a* as the plunger 12*a* begins forcing a closure blank 25 into the central opening of the die ring 11. As the plunger is extended further into the central opening of the die ring, however, an increasing amount of blank material will be forced into the grooves 18*a* of the plunger 12*a* since the increasing amount of blank material toward the perimeter of the blank 25 will necessitate greater material displacement in order to maintain a uniform outside diameter for the flange 28 of the closure 26. With the first preferred plunger configuration illustrated by FIGS. 7 and 8, the total void area between the plunger 12*a* and the inside surface 22 of the die ring 11 is preferably no more than the edge area ($C \times t$) of the blank in order to provide a positive compression of the closure means material at the outer edge of the annular flange thereof. Compression of up to about 1% is preferred with compression of from about 0.90% to about 1% being particularly preferred.

Figure 9:
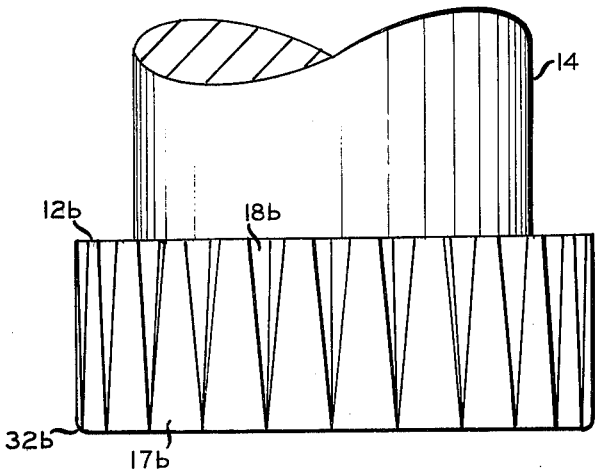
FIG. 9 is an elevational view of a second preferred plunger means of the invention.
Figure 10:
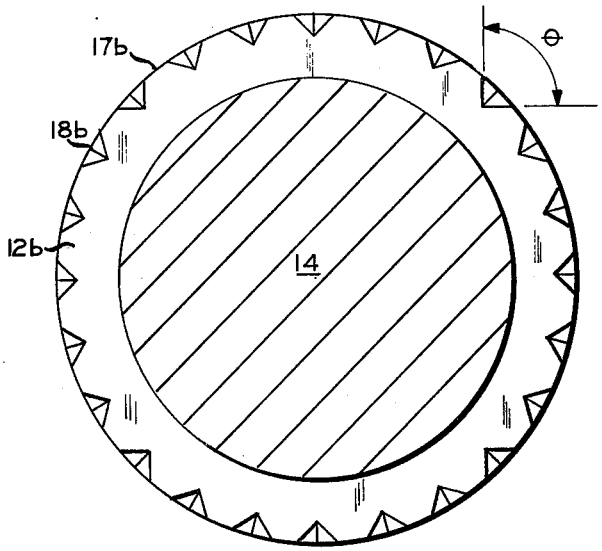
FIG. 10 is a plan view of the plunger means of FIG. 9.

A second preferred plunger embodiment illustrated by FIGS. 9 and 10 has a plunger 12*b* with a generally cylindrical annular outside surface 17*b*, and is generally similar to the first preferred embodiment illustrated by FIGS. 7 and 8. The second preferred embodiment, however, is characterized by grooves 18*b* which are tapered toward the rounded leading edge 32*b* of the plunger 12*b*. The tapered grooves 18*b* are subject to substantially the same design considerations as the grooves 18*a* with an angle $\theta$ of about 90° and sharp or only slightly rounded groove edges being presently preferred. In addition, however, the grooves 18*b* are preferably tapered so that the compression of material within the flange 28 of the closure means 26 produced thereby is more uniform over the entire width of the closure flange. It is therefore desirable that the void area between the plunger 12*b* and the inside surface 22 of the die ring 11 with which it will be associated will be no greater than the blank edge area to be encountered at each point along the plunger 12*b*. In other words, given a die ring 11 having a generally cylindrical inside surface 12 with a diameter D, the void area between the plunger 18*b* and the surface 22 at any distance X from the leading edge of the plunger 12*b* would preferably be substantially equal to or less than $\pi(D+2X)t$. Thus, where $X$ equals $(d-D)/2$, the void area would be substantially equal to or less than cxt, the edge area of the blank. It can be seen that such a configuration will result in compression of the pleats formed in the flange 28 of the closure means 26 along the entire length of the pleats, rather than primarily at the outer perimeter of the flange 28. With the second preferred embodiment of the plunger illustrated by FIGS. 9 and 10, compression of up to about 1% and particularly compression in a range of from about 0.90% to about 1% along the entire length of each pleat is preferred.

FIG. 10 is a pictorial illustration of a closure means of the invention. Such a closure means can be formed using either the plunger means 12*a* of FIGS. 7 and 8 or the plunger means 12*b* of FIGS. 9 and 10. The closure means 26 has a flat discoidal central surface 27 with an annular flange 28 extending therefrom. The pleats 29 formed by inward expansion of the closure material into the grooves of the plunger means 12, 12*a*, or 12*b* are preferably uniformly spaced and extend generally perpendicular to the outside perimeter 31 of the flange 28. The outside surface of the flange 28 is substantially continuous with the only manifestation of the pleats 29 appearing along the outside surface of the flange 28 being a hairline butt fold. Even these hairline folds do not extend to that portion of the flange 28 adjacent the central surface 27 since the uniform pleat size and spacing encourages uniform material compression and tends to prevent the formation of pleats until the amount of material in the flange 28 is too great to be shaped by compression alone. In addition to the minimal interruption of the outer surface of the flange 28 by the fold lines associated with the pleats 29, the absence of any fold line or other interruption on that portion of the flange 28 adjacent the central surface 27 assists in providing a firm, uninterrupted bond between the outside surface of the flange 28 and the inside surface of a container body 41. In accordance with the invention a closure 26 can be produced wherein the portion of the outside surface of the flange 28 adjacent the central surface 27 of the closure 26 is uninterrupted by surface irregularities to a distance of at least one-tenth to one eighth the width of the flange 28.

Figure 11:
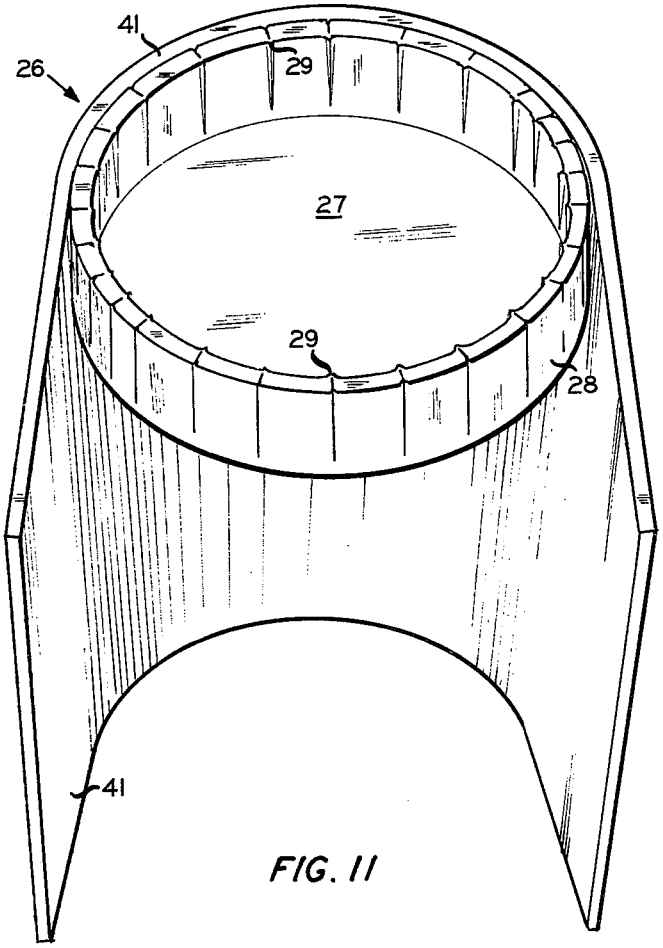
FIG. 11 is a perspective view of a preferred closure of the invention.
Figure 12:
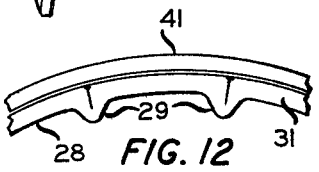
FIG. 12 is an illustration of the manner in which the closure of FIG. 11 can be fitted to a sidewall of a container.
Figure 13:
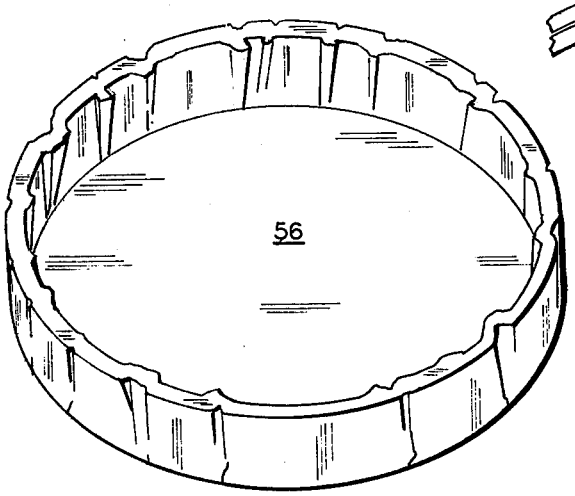
PRIOR ART FIG. 13
FIG. 13 is a pictorial view of a closure manufactured in accordance with the prior art.
Figure 14:
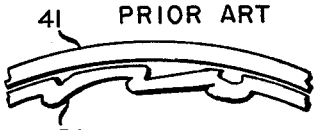
PRIOR ART FIG. 14
FIG. 14 illustrates the manner in which the closure of FIG. 13 is capable of being fitted to the sidewall of a container.

FIG. 12 illustrates the manner in which the closure of the invention is suited to mate with a surface such as the inside of a sidewall 41 of a container. Since the irregularities ordinarily resulting from formation of an annular flange 28 from the outer portion of a discoidal blank have been formed on the inside of the flange 28, the substantially continuous outside surface of the flange 28 will mate well with the container body 41 or other similar surface with the thin coating on either the container body 41 or the outside of the flange 28 or, if the container body 41 or closure 26 are formed from uncoated stock, a small amount of adhesive material, easily sealing any small fold lines associated with the pleats 29. The advantages of the closure 26 of the invention are illustrated by comparing the closure of FIG. 11 with the FIG. 13 pictorial representation of a closure 56 formed using prior art techniques employing a smooth plunger rather than the grooved plunger of the invention. Since this prior art method does not provide any guidance for the formation of folds or pleats, the additional material toward the periphery of the annular flange of the closure 56 becomes folded in a random manner with some folds being small and others large. The larger of these folds and irregularities often extend across the entire width of the flange to the point at which the flange joins the flat central surface of the closure thereby creating an interrupted surface adjacent even the central surface of the closure. In addition, the random folding of the material of the flange results in an outer surface which is equally as interrupted by folds, pleats and other irregularities as is the inside surface of the flange. FIG. 14 illustrates the difficulty which can be encountered in bonding the prior art closure 56 of FIG. 13 to the sidewall 41 of a container, for example. As indicated previously, the presence of irregularities in the flange or skirt of the closure member 56 will ordinarily result in an unacceptable number of leaky containers unless an additional coating is applied to the inside of the container after the closure has been applied and/or additional forming steps are undertaken which will compress the skirt of the closure 56 and the container wall 41 into more intimate contact with each other.

In addition to the advantages previously described, such as maintaining the surface of an annular flange which is to be mated with a smooth surface in a substantially smooth condition while allowing for expansion of excess material at a surface which is not to be mated, the apparatus and method of the invention have the advantage of utilizing a smooth surface of the inside of a die ring past which a blank will be forced to form a closure member and utilizing the irregular or grooved surface on a plunger which will remain stationary with respect to the blank during the closure-forming process. Since the blank is moved with respect to a smooth surface and held stationary with respect to the grooved surface of the plunger, the risk of tearing or disfiguring the blank and creating a faulty closure member is substantially diminished and is much less than would be encountered in an analogous process whereby the blank remained stationary with respect to a smooth surface and was moved with respect to a grooved or other irregular surface.

EXAMPLE

A draw die having a cylindrical internal diameter of 2.385 inches and a draw punch having a cylindrical outside diameter of 2.351 inches and provided with 80 grooves in accordance with the invention, the grooves being equally spaced around the circumference of the punch, were used to construct a bottom closure for a container from a circular closure blank having a diameter of 2.9375 inches and made from 0.017 inch thickness paperboard with a 0.0015 inch thick polymer coating, a total blank thickness of 0.0185 inch. Each of the 80 grooves was 0.023075 inch deep with the walls of the groove forming an angle of 90° to each other. The cross sectional area of the draw die was therefore 4.46753 sq. inches with a cross section of 4.34106 sq. inches being occupied by the draw punch leaving an available void area of 0.16095 sq. inches between the draw punch and the inside of a draw die. With the diameter and thickness of the blank being used, the edge area of the round disc blank was 0.17072 sq. inches or 0.00167 sq. inches in excess of the void area between the inside of the draw die passage and the outside of the draw punch. A compression of approximately 0.98% was therefore achieved at the perimeter of the flange on the closure when the coated paperboard blank was forced through the draw die by the draw punch to produce a closure member. Use of the closure member so produced in conjunction with a coated paperboard wall of the same stock as the closure blank with heat sealing of the outside of the closure member flange to the inside of the convoluted wall member followed by inward rolling of the heat sealed joint between the closure member and the side wall resulted in a leakproof container. A leakage test was made in which the container was filled with water and placed on a paper towel for 30 minutes. No leakage was observed. Use of the apparatus, method, and closure of the invention thereby resulted in production of a container which required neither additional crimping operations of the sidewall and closure junction, nor extreme pressures, nor additional inside coating in order to produce a leakproof container.

Although the invention has been described in conjunction with a preferred embodiment thereof, use of the invention for other than cylindrical containers and closure members having a generally continuously curved cross section which is free from sharp corners or having straight segments connected by continuously curved segments, use of the invention in conjunction with various available container materials, and other reasonable variations and modifications within the capability of those skilled in the art are considered to be within the scope of the invention and of the appended claims thereto.

I claim:

1. Apparatus for converting a substantially flat blank into a closure member having an annular flange folded to extend from a central portion, the inner surface of the flange having at preselected locations inwardly protruding pleats formed therein extending generally perpendicular to the perimeter of the flange, the outer surface of the flange being substantially smooth and continuous with substantially the only irregularities in the otherwise smooth outer surface of the flange being hairlines each of which coincides with the location of a respective one of said pleats on the inner surface of said flange, the outer surface of said flange providing said closure member with improved capability for mating with and sealing to a corresponding sidewall member, comprising:

an annular die ring means having a substantially smooth inner surface;

plunger means having an annular external surface located adjacent a leading end thereof and sized to cooperate with said inner surface of said die ring means, said external surface of said plunger means having a plurality of grooves formed on the surface thereof, the central axis of each said groove being substantially coplanar with the central axis of said annular external surface of said plunger means; and means for inserting said leading end of said plunger means into said die ring means so that a flat blank positioned between said plunger means and said annular die ring means is converted to said closure member.

2. Apparatus in accordance with claim 1 wherein said annular die ring means has an inside diameter D for receiving a discoidal blank having a diameter *d*, circumference *c*, and thickness *t*, the diameter D of said die being smaller than the diameter d of said blank; and wherein the depth of each said groove is less than about 1.3 *t*.

3. Apparatus in accordance with claim 2 wherein the depth of each said groove is less than about *t*.

4. Apparatus in accordance with claim 1 wherein said annular die ring means has an inside diameter D for receiving a discoidal blank having a diameter *d*, circumference *c*, and thickness *t*, the diameter D of said die being smaller than the diameter *d* of said blank; and wherein the perimeter of said plunger means measured at a distance $(d - D)/2$ from said leading end thereof is approximately equal to the circumference *c* of said blank.

5. Apparatus in accordance with claim 4 wherein the area of the opening of said annular die ring means exceeds the cross sectional area of said plunger means at a location $(d - D)/2$ from the leading edge of the plunger by an amount substantially equal to the edge area of said discoidal blank, $(c \times t)$.

6. Apparatus in accordance with claim 5 wherein the depth of each said groove is less than about 1.3 *t*.

7. Apparatus in accordance with claim 6 wherein the depth of each said groove is less than about *t*.

8. Apparatus in accordance with claim 1 wherein said annular die ring means has an inside diameter D for receiving a discoidal blank having a diameter *d*, circumference *c*, and thickness *t*, the diameter D of said die being smaller than the diameter *d* of said blank.

9. Apparatus in accordance with claim 8 wherein the area of the opening of said annular die ring means exceeds the cross sectional area of said plunger means at a location $(d - D)/2$ from the leading edge of the plunger by an amount substantially equal to the edge area of said discoidal blank, $(c \times t)$.

10. Apparatus in accordance with claim 9 wherein the depth of each said groove is less than about 1.3 *t*.

11. Apparatus in accordance with claim 10 wherein the depth of each said groove is less than *t*.

12. Apparatus in accordance with claim 8 wherein the depth of each said groove is less than about 1.3 *t*.

13. Apparatus in accordance with claim 12 wherein the depth of each said groove is less than about *t*.

14. Apparatus in accordance with claim 8 wherein the depth of each said groove is uniform.

15. Apparatus in accordance with claim 8 wherein the depth of said grooves is decreased toward the leading edge of said plunger means.

16. Apparatus in accordance with claim 8 wherein the area of the opening of said annular die ring means exceeds the cross sectional area of said plunger means by an amount substantially equal to $\pi(D + 2X)t$ where *X* is any distance up to $(d-D)/2$ from the leading end of said plunger means.

17. Apparatus in accordance with claim 16 wherein the depth of each said groove at a location approximately $(d - D)/2$ from the leading end of said plunger means is less than about 1.3 *t*.

18. Apparatus in accordance with claim 17 wherein the depth of each said groove at a location approximately $(d - D)$ from the leading end of said plunger means is less than about *t*.

19. A method for converting a substantially flat closure blank into a closure member having an annular closure flange folded to extend from a central portion, the inner surface of the flange having at preselected locations inwardly protruding pleats formed therein extending generally perpendicular to the perimeter of the flange, the outer surface of the flange being substantially smooth and continuous with substantially the only irregularities in the otherwise smooth outer surface of the flange being hairlines each of which coincides with the location of a respective one of said pleats on the inner surface of said flange, the outer surface of said flange providing said closure member with improved capability for mating with and sealing to a corresponding sidewall member, said method comprising simultaneously:

reforming a peripheral portion of a substantially flat closure blank to form an annular flange extending from a central portion of said blank;

maintaining the outer surface of said annular flange in contact with an annular surface having the size and at least substantially smooth surface characteristics of the desired closure flange; and shaping inwardly protruding pleats extending generally perpendicular to the perimeter of said flange at preselected locations along the inside of said annular flange.

20. A method in accordance with claim 19 wherein shaping inwardly protruding pleats at preselected locations along the inside of said flange comprises providing a plurality of spaces of preselected size at regular intervals along said flange into which said pleats can form while maintaining all other portions of said flange in contact with said annular surface.

21. A method in accordance with claim 20 additionally comprising compressing at least a portion of each said pleat.

22. A method in accordance with claim 21 wherein compressing each said pleat comprises applying up to about 1% compression to each pleat at the extreme perimeter of said blank forming the edge of said annular flange.

23. A method in accordance with claim 22 wherein said compression is at least about 0.90%.

24. A method in accordance with claim 22 wherein compressing each said pleat comprises applying up to about 1% compression along the entire length of each said pleat.

25. A method in accordance with claim 24 wherein said compression is at least about 0.90%.

* * * * *

UNITED STATES PATENT AND TRADEMARK OFFICE

CERTIFICATE OF CORRECTION

PATENT NO. : 4,084,488

DATED : April 18, 1978

INVENTOR(S) : Alfred W. Kinney

It is certified that error appears in the above-identified patent and that said Letters Patent are hereby corrected as shown below:

Column 9, line 51, after "than" insert --- about ---.

Column 10, line 10, "(d - D)" should read --- $\frac{(d - D)}{2}$ ---

Signed and Sealed this

*Fifth* Day of *August 1980*

[SEAL]

*Attest:*

SIDNEY A. DIAMOND

*Attesting Officer*

*Commissioner of Patents and Trademarks*